US005697362A

United States Patent [19]

Albrecht

[11] Patent Number: 5,697,362

[45] Date of Patent: Dec. 16, 1997

[54] SWIMMING DEVICE

[76] Inventor: Glenn C. Albrecht, 8721 Cummings Rd., Wittman, Md. 21676

[21] Appl. No.: 534,459

[22] Filed: Sep. 27, 1995

[51] Int. Cl.[6] ..... B63C 11/16

[52] U.S. Cl. ..... 128/201.11; 128/201.27; 128/201.26

[58] Field of Search ..... 128/200.29, 201.11, 128/201.12, 201.26, 201.27, 201.28, 201.18, 207.18, DIG. 26

[56] References Cited

U.S. PATENT DOCUMENTS

| | | | |
|---|---|---|---|
| 46,902 | 3/1865 | Hawkins | 128/201.11 |
| D. 120,372 | 5/1940 | Bothby et al. . | |
| 156,599 | 11/1874 | Schmitz | 128/201.11 |
| D. 171,482 | 2/1954 | Bickel . | |
| 183,521 | 10/1876 | Weck | 128/201.11 |
| D. 215,982 | 11/1969 | Wise et al. . | |
| D. 228,476 | 9/1973 | Ferguson et al. . | |
| 690,663 | 1/1902 | Pratt | 128/201.11 |
| 1,210,939 | 1/1917 | Hilgers | 128/201.11 |
| 1,727,202 | 5/1929 | Greer | 128/201.11 |
| 1,845,263 | 12/1932 | Girden . | |
| 2,376,871 | 5/1945 | Fink . | |
| 2,859,747 | 2/1958 | Stampe . | |
| 2,868,196 | 8/1959 | Stampe . | |
| 3,265,066 | 8/1966 | Katehis . | |
| 3,315,672 | 4/1967 | Cunningham et al. . | |
| 3,802,431 | 4/1974 | Farr | 128/207.18 |
| 4,055,174 | 10/1977 | LeVasseur . | |
| 4,245,632 | 1/1981 | Houston | 128/201.11 |
| 4,470,413 | 9/1984 | Warncke | 128/201.18 |
| 4,878,491 | 11/1989 | McGilvray, III | 128/201.11 |
| 5,199,421 | 4/1993 | Figgiani et al. | 128/201.11 |
| 5,485,832 | 1/1996 | Joffity | 128/201.11 |
| 5,487,379 | 1/1996 | Koshiishi | 128/201.28 |

FOREIGN PATENT DOCUMENTS

| | | | |
|---|---|---|---|
| 0212610 | 8/1956 | Australia | 128/201.11 |
| 0780018 | 4/1935 | France | 128/201.11 |

*Primary Examiner*—V. Millin
*Assistant Examiner*—V. Srivastava
*Attorney, Agent, or Firm*—Nixon & Vanderhye P.C.

[57] ABSTRACT

A swimming device designed to more easily facilitate the ingestion of air during the act of swimming is disclosed. The device permits the user to expend less effort breathing and focus more attention to the motor activity. The device improves the existing art of recreational snorkeling devices since its design is less cumbersome, more hydrodynamically streamlined, and causes less fatigue to the mouth and jaw muscles. The device of the invention consists of two flexible breathing tubes which encircle the user's head from the mouth, pass below the ears, join and pass through an adjustable slip piece, and then project upward and forward above the rear portion of the user's head to permit air induction free of water. At the interface of the mouth of the user, the breathing tubes are joined by a mouthpiece which has a small ribbed tube for the user to hold the device with his teeth. The device when properly tensioned with the adjustable slip piece provides a snug and self holding fit which requires no clenching of teeth or lips to maintain the position of the device. When the device is loosened by moving the slip piece along the tubes away from the mouthpiece, it easily stores around the user's neck and is independent of swim goggles or a snorkeling mask.

21 Claims, 6 Drawing Sheets

26
23
65
66
76
77
9
9
64
60
63
30
42
6
44
46
45
10
20
41
40
43
6
47

126
124
123
165
166
168
167
109
109
164
160
163
130
142
106
110
120
140
143
147
106

SWIMMING DEVICE

BACKGROUND OF THE INVENTION

1. Field of the Invention

The present invention facilitates surface swimming, either extended intervals of freestyle or breaststroke swimming, or recreational snorkeling which entails both surface and below surface swimming. The device permits a more effortless condition; it eliminates the repetitious act of turning the head to ingest air. The act of turning the head to above water level for air is deemed less efficient due to the added physical requirement. This repeated motion, however, also creates added hydro-static drag. The subject invention permits a more balanced and consistent swimming position, and less attention to breathing is required by the user permitting more dedicated attention to the act of propulsion through the water. The invention requires little mouth and jaw related effort thus providing comfortable use. The improved hydrodynamics result in less tugging around lips and gums when diving and swimming. The invention offers easy comfort and positioning adjustment when in use or in a self storing position around the neck. Since the device is free of goggle straps or ear pieces, pinching or fouling with hair is significantly reduced, and crossing or interference from goggle straps is eliminated due to the self supporting, under ear design.

2. Description of the Prior Art

Current art of snorkel devices consists of mouthpieces intended both for channeling air into the lungs, and for maintaining secure placement of the apparatus by biting or clenching by the user. Prolonged usage can cause considerable fatigue and discomfort. This current art requires a secondary or tertiary point of support above or in front of the ear, in the form of either temple pieces or loops that attach at or above the ears, or in the form of a tether which connects to a goggle retaining strap. These secondary or tertiary points of contact are intended to maintain proper access to the air above, and to resist the water induced force generated by the act of forward propulsion. The water induced force tends to pull the upward extended breathing tubes backwards towards the water. Ear mounted retainers tend to chaff the skin at the point of contact and are cumbersome. These designs interfere with swimming goggles or snorkel masks. Designs which rely upon support points connected to the actual straps are cumbersome and tend to foul with hair.

The following U.S. patents disclose various types of swimming devices known in the prior art:

U.S. Pat. No. 183,521 discloses an integrated suit, mask and breathing apparatus.

U.S. Pat. No. 690,663—discloses a rigid front mounted apparatus with a rear facing strap for secure attachment.

U.S. Pat. No. 46,902 discloses a device intended for extended periods under water. The mouthpiece design includes intake of air from one side and exhaust from the opposite side via a control valve system.

U.S. Pat. No. 1,845,263 discloses a single intake unbalanced snorkel device, a design popular for the dedicated activity of snorkeling.

U.S. Pat. No. 3,265,066 discloses a mouthpiece and two breathing tubes which pass through two buoyant spheres that connect to a single ratcheting tube fitting for purposes of communicating to the atmosphere.

U.S. Pat. No. 1,727,202 discloses a swimming appliance.

U.S. Pat. No. 5,199,421 discloses an integrated snorkel/mask configuration with a conventional strap arrangement to secure to the user's head.

U.S. Pat. No. 4,878,491 discloses a pair of breathing tubes which encircle the user's head above the ears. The tubes are secured to the user's head with either a conventional strap or eyeglass type ear hooks.

U.S. Pat. No. 4,055,174 "Swimming system", discloses a swimming suit which includes a mouthpiece with tubes leading around the user's neck.

The following U.S. patents illustrate various types of breathing apparatus with tubing attached thereto:

U.S. Pat. Nos. 2,859,747 and 2,868,196 disclose a mask with filter tubing attached.

U.S. Pat. No. 2,376,871 discloses a mask with tubes leading to a single gas passageway, intended as a "Respirator Mask."

U.S. Pat. No. 3,315,672 discloses a "Surgical Mask" with a shield molded to the usual contour of the face, and to which is attached an air exhaust conduit.

U.S. Pat. No. Des. 228,476, "Combined Oxygen Mask And Holder", discloses a mouthpiece with tubing attached to a source of oxygen.

U.S. Pat. No. Des. 215,982, "Disposable Anesthetists' Kit" discloses a mask with tubing attached which extends to a source of gas.

U.S. Pat. No. Des. 171,482, "Respirator," discloses a respirator with short tube passages extending laterally from the breathing portion.

U.S. Pat. No. Des. 120,372, "Nasal Mask," discloses a mask with a pair of downwardly extending passageways which merge into a single passageway.

SUMMARY OF THE PRESENT INVENTION

The subject invention relates to a device for facilitating the breathing of a swimmer comprising

- a first tube having a first end and a second end
- a second tube of approximately the same length as said first tube and having a third end disposed near said first end and a fourth end disposed near said second end;
- a mouthpiece having a first hollow extension adapted to be received by the mouth of said swimmer, a second hollow extension receiving said first end, and a third hollow extension receiving said third end;
- a slip member having a chamber, advantageously a first and second chamber slidably receiving said first and second tubes intermediate their lengths; and
- locking means fixing said slip member at a selected position along said tubes.

DETAILED DESCRIPTION OF THE INVENTION

The present invention is a hydrodynamically designed device which facilitates comfortable swimming, above and below the surface of the water. Simplicity, improved human ergonomics, and ease of manufacture and maintenance are inherent elements of the invention. The device permits the user to swim freestyle or breaststroke, without the work intensive and drag increasing act of repeatedly turning the head and gasping for air. The invention permits a more dedicated pursuit of the act of propulsion and the exercise benefits derived therefrom.

Figure 2:
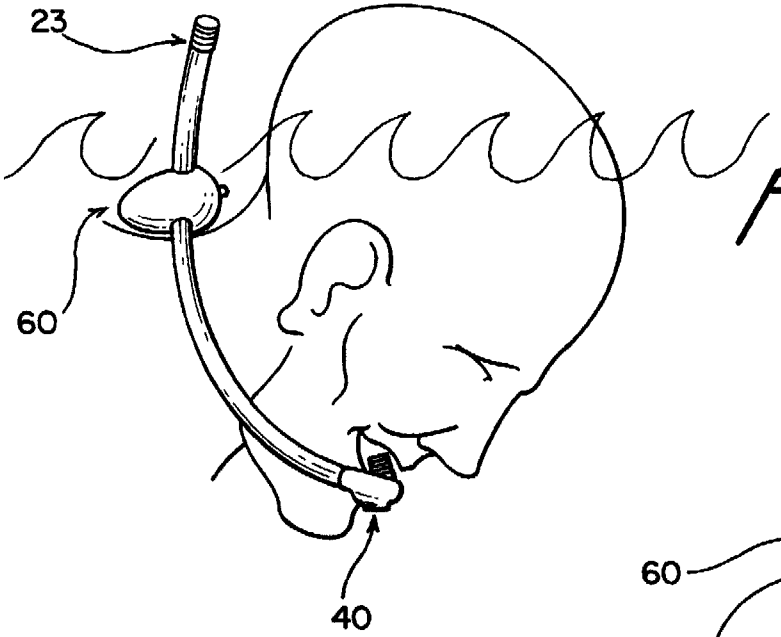
FIG. 2 is a side elevation of the invention as used by a swimmer.
Figure 3:
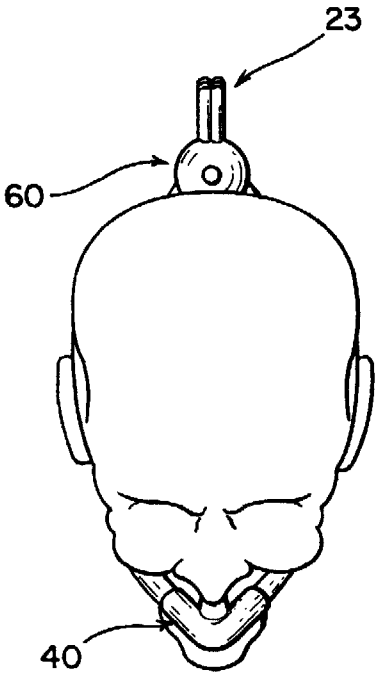
FIG. 3 is a front elevation of the invention as used by a swimmer.

The present invention 10 consists of two lengths of flexible breathing tube 20 and 30 joined at a mouthpiece 40, the tubes project backwards and encircle the user's head below the ears and are brought together at the nape of the neck by passing through a buoyant ovoid slip piece 60. The slip piece 60 acts as a joining device to permit tensioning of the flexible tubes 20 and 30 to snugly fit the user's head. After the tubes pass through the slip piece 60, the tubes 20 and 30 project upwards and forward (see FIG. 2) to air available above the swimmer's head. At this point, the two tube ends 26 are joined in parallel with a connecting collar 23.

The tubes are connected adjacent the user's mouth by a mouthpiece 40 which permits the user a free flow of air via both sides of the encircling tubes. The mouthpiece 40 permits adequate air flow, a relative and proper positioning of the tubes to the user's mouth, and proper spacing between the teeth.

The mouthpiece 40 is designed to minimize the amount of active gripping required by prior art devices. This reduction of active gripping is facilitated by the properly tensioned flexible tubes 20 and 30 holding the device to the user's face and mouth. The mouthpiece 40 minimizes fatigue associated with extended use of prior art mouthpieces. The fatigue caused by these mouthpieces is due to the effort of the jaws to grip the mouthpiece and the lack of provisions to accommodate human overbites. A multiplicity of raised ridges 45 on top and bottom of the mouth piece 40 permits individual users to comfortably accommodate individual overbite variances, thus diminishing fatigue.

Figure 4:
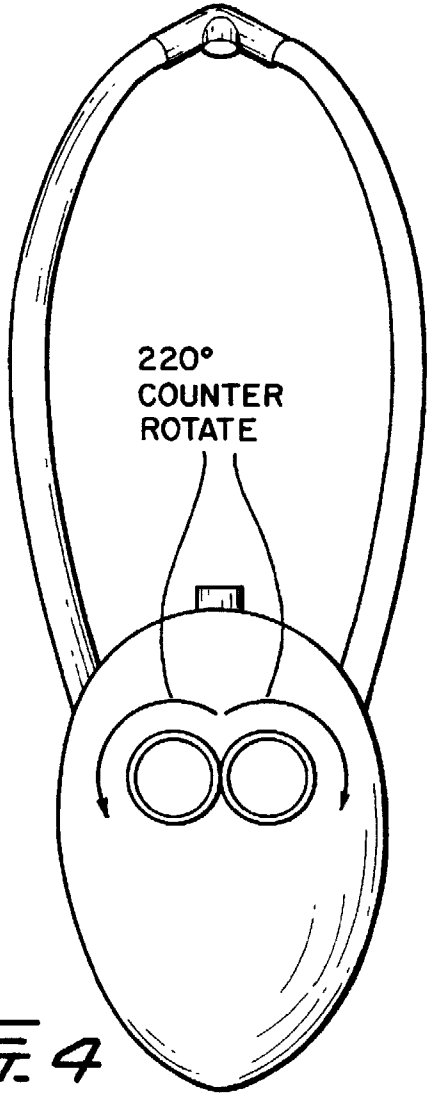
FIG. 4 is a top elevation of the breathing tubes, indicating manipulation of said tubes prior to joining with retaining clamps.

It has also been discovered that employing the proper durometer flexible tubes 20 and 30, then twisting the ends in counter rotated fashion (see FIG. 4), creates a natural gripping spring which more naturally conforms to the shape of the human head. The tube twisting creates a tighter and more evenly distributed gripping action; hence a more comfortable fit. This arrangement also decreases hydrodynamic drag, enhancing efficiency. Rotating and inducing internal tensioning of the tubes 20 and 30, creates a curve that naturally directs the breathing tubes forward and up from the nape of the user's neck to the optimal position for swimming. Air enters but water does not.

The slip piece 60, which acts as a sliding tension adjuster, possesses two significant design qualities, a comfortable shape/interface with the nape of the neck which exerts resistive leverage against the effects of water pressure against the breathing tubes. Advantageously, the slip piece 60 has a very efficient low drag shape.

It has been found that the low drag of the device 10 reduces lip and gum chaffing associated with prior art devices. It is also noted that for purposes of recreational snorkeling that ease of installing, adjusting, and self-storing the device while actually in deep water is significantly improved.

The Breathing Tubes

The breathing tubes 20 and 30 are typically made up of a flexible plastic material, e.g., UHMW plastic, polycarbonates, polyethylene, urethane, silicone, PVC, self skinning urethane plastic foam, or foam rubber. The material selected should have the proper durometer and resiliency such that when the breathing tubes 20 and 30 are passed through the slip piece 60, then counter-rotated from each other (advantageously approximately 220 degrees) (FIG. 4), then joined with a collar 23, the inner tension of the joined tubes creates a self supporting, upward curving elliptical spring in the device 10. This effect 1) supplies a spring loaded characteristic that causes the breathing tubes 20 and 30 to hug and hold the user's face and neck aiding the inherent support of the appliance, and 2) generates the desired curve from back to forward that places the intake ports 26 of the tubes to atmosphere permitting the intake of air and not water. This arrangement creates a self-supporting, hydrodynamically resistive structure.

The Mouthpiece

Figure 5:
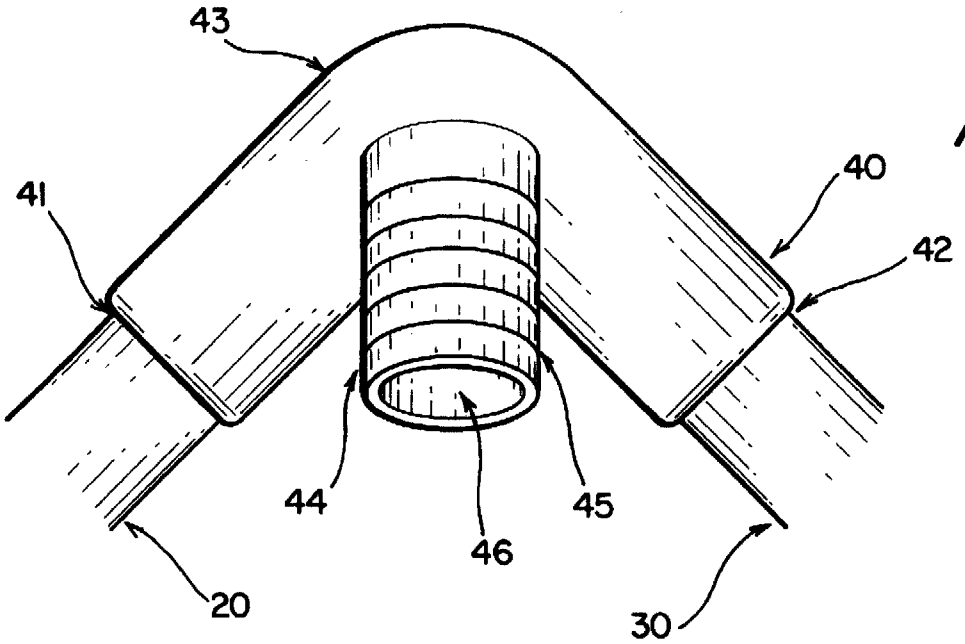
FIG. 5 is a top elevation of the mouthpiece/joining chamber.
Figure 6:
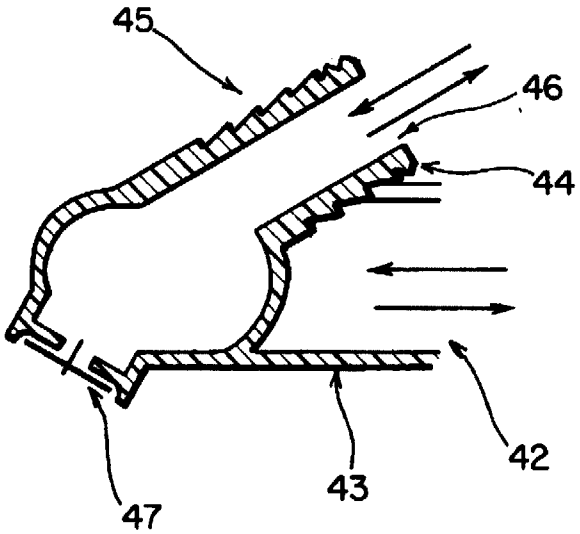
FIG. 6 is a cross-sectional view taken along line 6—6 of FIG. 1.

The mouthpiece 40 is typically a plastic, for example, urethane, silicone, PVC, self skinning urethane foam or foam rubber, and advantageously has three major features molded into one component (FIGS. 5 and 6):

1) One elbow 43 (advantageously 90 degrees) with two approximately ½–1 inch diameter openings 41 and 42 which point rearward from user's mouth. The two rear facing openings 41 and 42 receive the two breathing tubes 20 and 30 that encircle the user's jaw's and proceed backwards and upwards to the atmosphere to a height of advantageously about 4–6 inches above the back of user's head (see FIG. 2).

Figure 1:
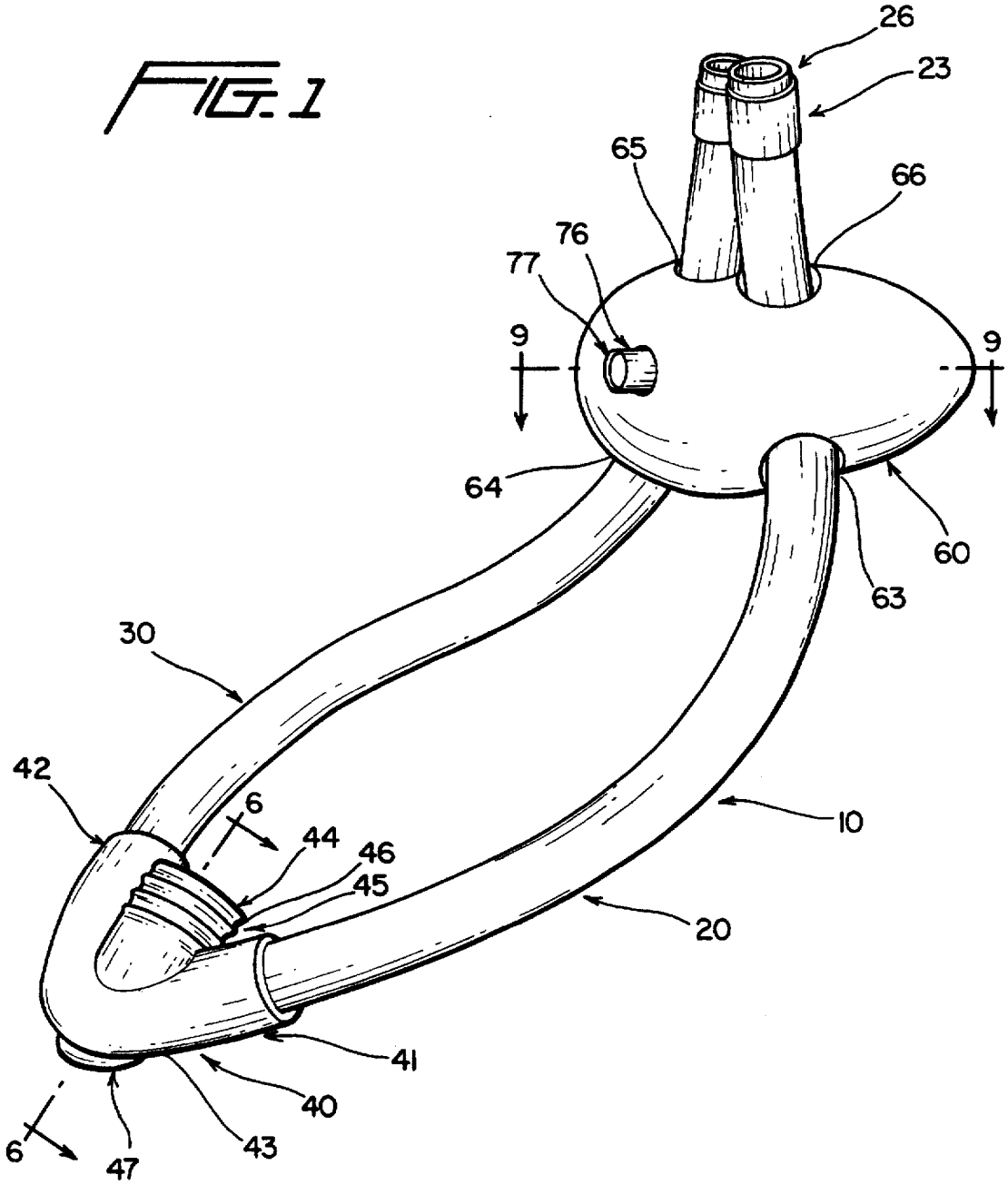
FIG. 1 is a perspective view of one embodiment of the present invention.

2) The flexible oval tube 44 which is connected to the elbow 43 as illustrated in FIG. 1. The oval tube 44 projects back and up at an approximate angle of advantageously 20–30 degrees (FIG. 6) for a distance of about one inch. Encircling the oval tube are raised ridges 45 for the user to position teeth for positive resistance and for comfortable alignment. The frequency of the raised ridges 45 accounts for standard overbite. This permits placing the mouth and jaw in a relaxed positioning in order to minimize mouth and jaw fatigue. The anterior opening 46 of the oval tube 44 is suitably rounded (or edges eased) to facilitate the comfortable sealing with the user's tongue, which is common when the user dives under water. Sealing the opening 46 prevents excessive invasion of water into the device 10.

3) Item 3 is a purge valve or single direction check valve 47 located at the bottom of the elbow 43 as illustrated in FIG. 1. The valve 47 permits draining of water which can accumulate after diving below the water surface.

Slip Piece

The slip piece 60 of the invention is typically made of self skinning urethane foam, foam rubber, urethane silicone, PVC or cork. The purpose of this component is to properly hold and align the breathing tubes 20 and 30 in a functional position. The slip piece 60 permits the user of the device 10 to obtain a comfortable snug fit with a minimum of effort. This is important while afloat with wet hands.

Figure 8:
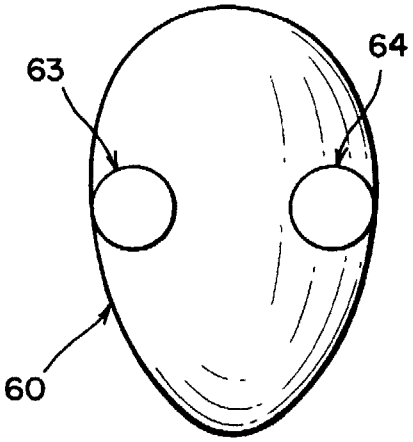
FIG. 8 is a bottom elevation of one embodiment of the slip piece of invention.
Figure 7:
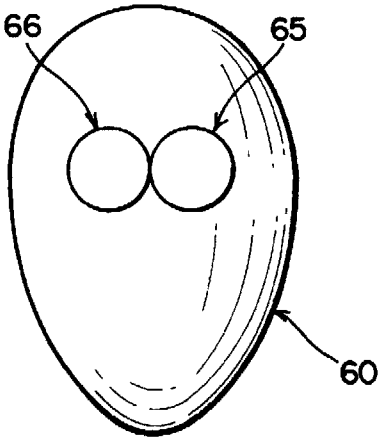
FIG. 7 is a top elevation of one embodiment of the slip piece of the invention.
Figure 10:
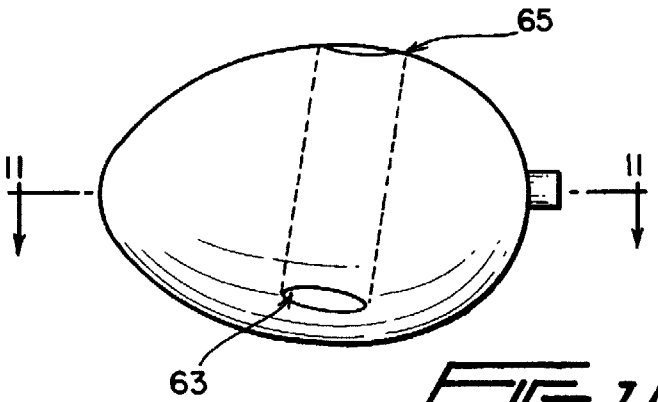
FIG. 10 is a side elevation of one embodiment of the slip piece of invention.

The main body of the slip piece 60 has an ovoid shape with two openings 63 and 64 to two cylindrical chambers which start at the base of the slip piece 60, slightly forward of mid point, angularly opposed at a distance apart coincidal with the width of the nape of one's neck, (advantageously about 1–2 inches) and proceeding upward at advantageously about 15 degrees off vertical (FIG. 10) with the two exit openings 65 and 66 being adjacent to one another (see FIGS. 7 and 8). Sizing of these openings 63, 64, 65 and 66 and the chambers is made to accommodate easy insertion of the breathing tubes 20 and 30, plus of slip tolerance to facilitate ease of sliding of slip piece 60 along the breathing tubes 20 and 30. In one embodiment of the invention, a very small tolerance is used to permit friction locking to achieve the desired result of locking the device 10 in place on the swimmer's head.

Figure 9:
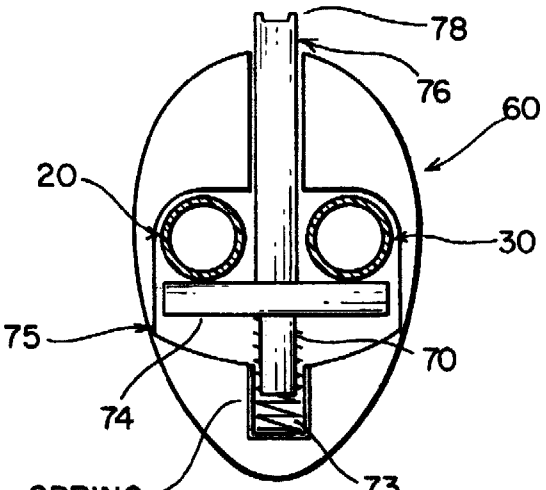
FIG. 9 is a cross-sectional view of one embodiment of the slip piece taken along line 9—9 of FIG. 1.
Figure 11:
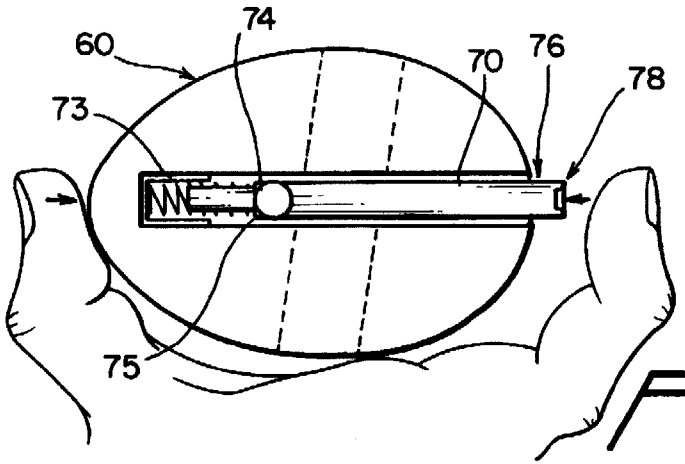
FIG. 11 is a cross-sectional view of one embodiment of the slip piece taken along line 11—11 of FIG. 10.

In another embodiment, there is a component that facilitates a positive locking characteristic. Specifically, the slip piece 60 includes a spring actuated tee shaped clamp element 70, having a stem 76 and arms 74, positioned for reciprocal movement in clamping pocket 75 of slip piece 60. When at rest, the spring 73 exerts positive pressure on the internal end of the stem 76 of clamp element 70 which in turn exerts pressure on the two breathing tubes 20 and 30 by forcing them against the walls of the two chambers of the slip piece 60. Gripping is also obtained at the point of interface of the tubes 20 and 30 with the arms 74 of the tee shaped clamp element 70, as illustrated in FIG. 9. Release of locking tension is obtained by exerting force with the thumb and finger, as illustrated in FIG. 11. FIG. 9 demonstrates recess at release actuator button tip 78 designed for positive grip and alignment for use with wet fingers. Application of pressure to release actuator button tip 78, releases active pressure from the spring loaded, tee shaped clamp element 70 to permit repositioning of the slip piece 60 along tubes 20 and 30 to facilitate either tightening the fit downward towards the neck, or loosening upward to remove the device 10.

Advantageous materials for the main body of the slip piece 60 are a self skinning injected foam rubber. The material for the slip piece 60 should be lightweight, water impermeable buoyancy, soft non-chaffing to skin and moderately pliable for purposes of shock absorption to aid in a comfortable and snug fit. The locking spring mechanism is a self contained internal unit which contains two moving parts, i.e., lightweight high impact plastic or nylon clamp element 70 with a corrosion proof stainless steel or composite spring 73 positioned in pocket 75. This makes the mechanism less susceptible to damage and avoids pinching of fingers or fouling with the user's hair.

An alternative embodiment of the slip piece 160 is shown in FIGS. 12, 13, 14, 15, 16 and 17. As shown in FIGS. 12–17 in one embodiment of the invention, the tubes have a D shape profile. These figures show breathing tubes 120 and 130 passing through main body of slip piece 160 at openings 163 and 164 to D shape chambers which start at the base of the slip piece 160, slightly forward of mid point, angularly opposed at a distance apart coincidal with the width of one's neck, and proceeding upward and forward at advantageously about 15 degrees off vertical with the two exit openings 165 and 166 being adjacent to one another (see FIG. 13 and 14). Sizing of these chambers is made to accommodate easy insertion of the breathing tubes 120 and 130, plus small tolerance for sliding. In one embodiment, a very small tolerance is used to permit friction locking.

In another embodiment (FIG. 12), locking is provided by an externally mounted oval band 167 which sits in channel 168. The channel 168 and band 167 encircle both the slip piece 160 and tubes 120 and 130. Channel 168 is a groove in the main body of the slip piece 160 at a depth of advantageously about 0.2 inch, and encircles longitudinally slip piece 160. The band 167 is sized to fit securely within channel 168 (see FIG. 16) and interfaces with the exposed breathing tubes 120 and 130. To enhance locking capacity, the outer face of tube 120 and 130 (see FIG. 14) are serrated as shown as 122 and 132 (see FIG. 16), these grooves interface with a raised bead 169 on the inside facing surface of band 167. The normal or neutral position of the slip piece 160 will be the locked position, the process of release is accomplished via application of pressure (see FIG. 17) using the index finger and thumb. The application of compressive pressure (see FIG. 17) forces band 167 away from breathing tubes 120 and 130 at interface points 125 and 135 (see FIG. 16), hence releasing resistance and permitting a sliding adjustment to be made, either to tighten or loosen the device 110.

Figure 12:
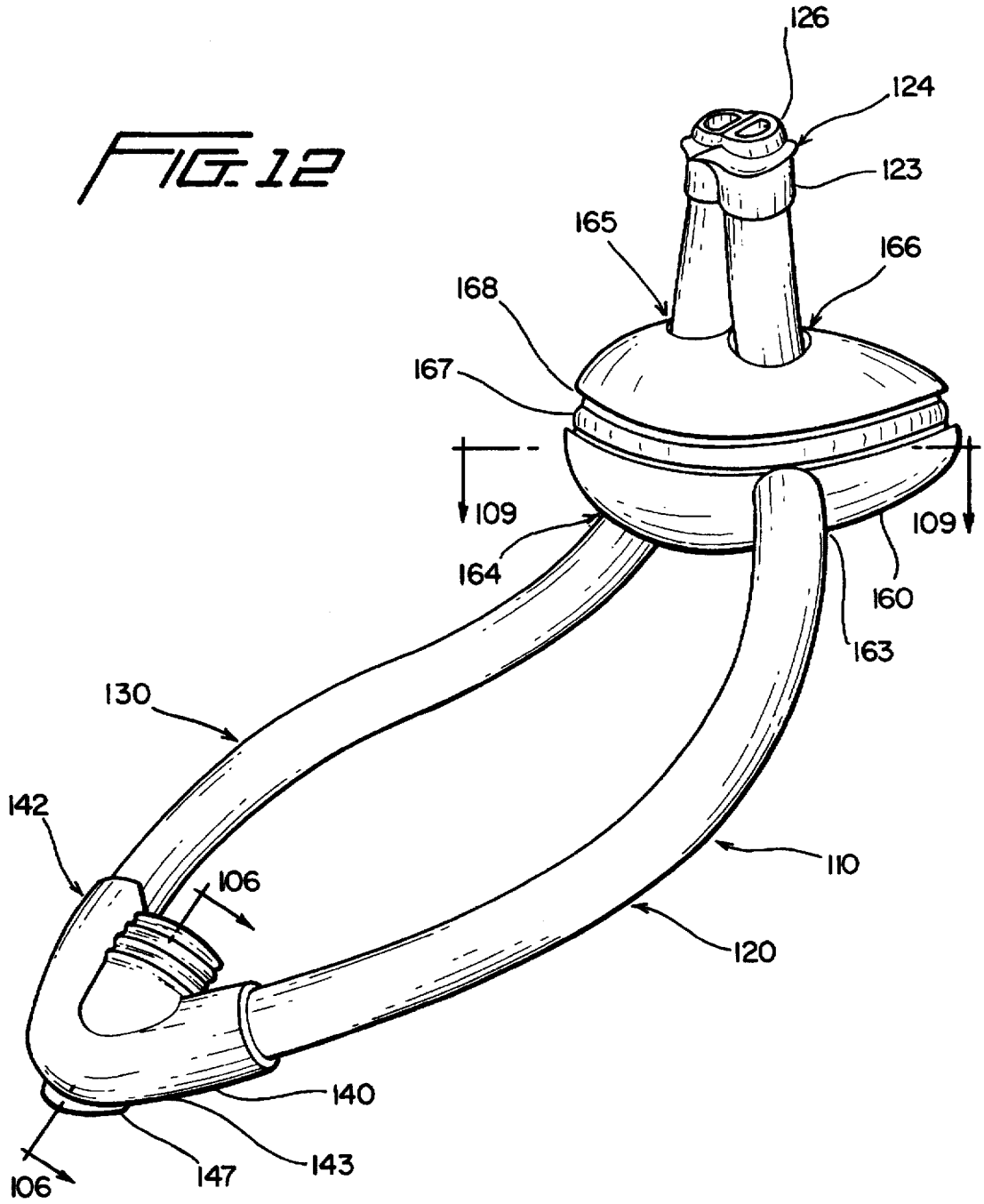
FIG. 12 is a perspective view of an alternative embodiment of the invention.
Figure 15:
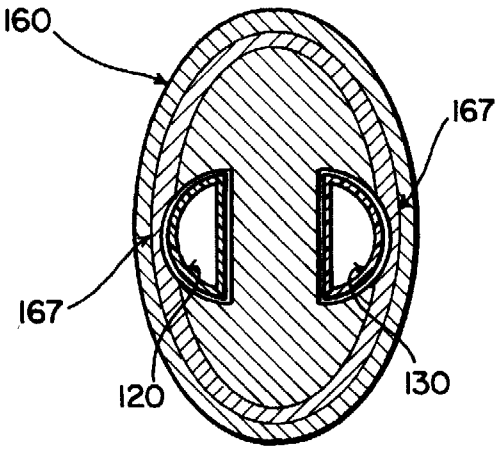
FIG. 15 is a cross-sectional top elevation of an alternative embodiment of the slip piece of the present invention at line 109—109 of FIG. 12.
Figure 14:
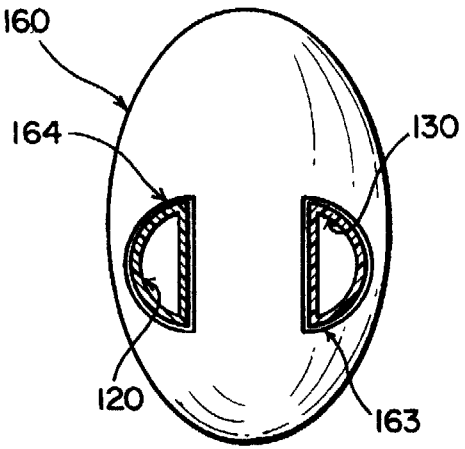
FIG. 14 is a bottom elevation of an alternative embodiment of the slip piece.
Figure 13:
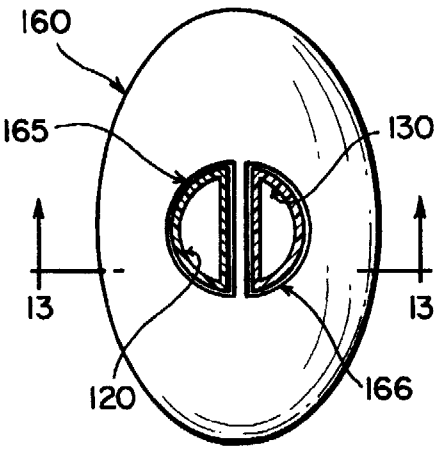
FIG. 13 is a top elevation of an alternative embodiment of the slip piece.
Figure 17:
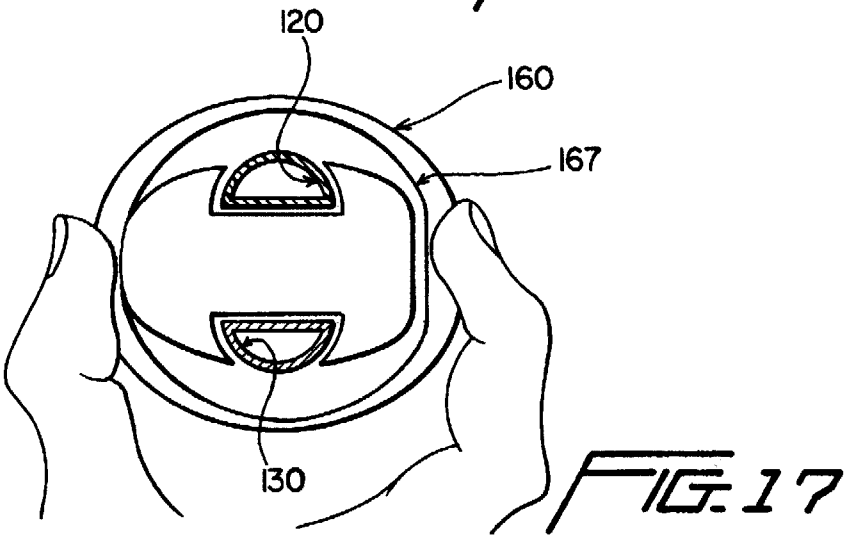
FIG. 17 is a cross-sectional top elevation of an alternative embodiment of the slip piece of the invention taken at line 109—109 of FIG. 12, illustrating the release technique utilizing the oval band.
Figure 16:
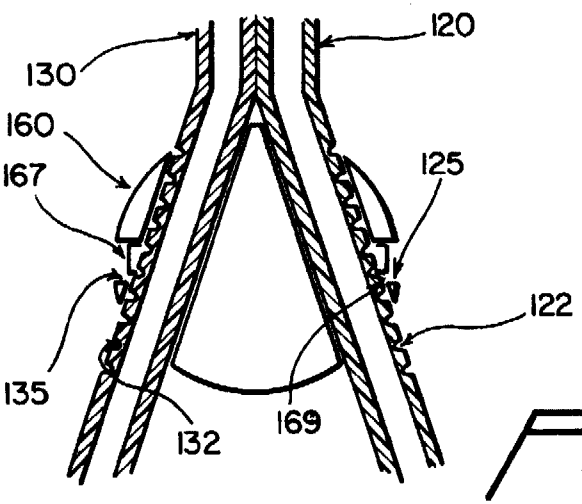
FIG. 16 is a cross-sectional front elevation of an alternative embodiment of the slip piece; detail of external spring and breathing tube interface.

FIG. 12 shows an alternative embodiment of the restraining collar 123, an additional flare 124 is incorporated into the body of the collar 123 to facilitate the lateral redirection of water away from the intake ports 126 of breathing tubes 120 and 130.

The foregoing is intended as illustrative of the present invention but not limiting. Numerous variations and modifications may be effected without departing from the true spirit and scope of the invention.

What is claimed is:

1. A device for facilitating the breathing of a swimmer comprising a first tube having a first end and a second end;

a second tube of approximately the same length as said first tube and having a third end disposed near said first end and a fourth end disposed near said second end;

a mouth piece having a first hollow extension adapted to be received by the mouth of a swimmer, a second hollow extension receiving said first end, and a third hollow extension receiving said third end;

a slip piece having first and second chambers slidably receiving said first and second tubes intermediate their lengths and wherein said first tube and said second tube together circumscribe the head of a swimmer from the mouth of a swimmer to a point near the nape of the neck of a swimmer and form a generally circular loop; and locking means for fixing said slip piece at a selected position along said tubes so that the size of said loop can be reduced to increase the tension of said tubes about the head of the swimmer for self-support and to firmly position said first hollow extension in the mouth of a swimmer.

2. The device of claim 1 wherein said mouthpiece includes a purge valve.

3. The device of claim 1 wherein said second and fourth ends have tubular segments extending beyond said slip piece and having open ends communicated to the atmosphere.

4. The device of claim 1 wherein said selected position defines a space between said tubes the approximate size of a wearer's head perimeter between the mouth and the nape of the neck of said swimmer.

5. The device of claim 1 wherein said tubes are flexible.

6. The device of claim 1 wherein said mouthpiece hollow extensions are in communication with one another.

7. The device of claim 1 wherein an outer surface of said first hollow extension is serrated to facilitate mouth retention by said swimmer.

8. The device of claim 1 wherein said second and third hollow extensions are disposed at an angle with respect to one another.

9. The device of claim 8 wherein said first hollow extension bisects said angle.

10. The device of claim 9 wherein said angle is approximately 90° and second and third hollow extensions contact the face of said swimmer when said mouthpiece is received by the mouth of said swimmer.

11. The device of claim 9 wherein a collar member secures said tubes in a side by side relationship adjacent said second and fourth ends.

12. The device of claim 1 wherein said slip piece is ovoid in shape.

13. The device of claim 1 wherein said chambers are cylindrical in shape.

14. The device of claim 1 wherein said locking means is a very small tolerance between the interior surfaces of said chambers and the exterior surfaces of said tubes permitting friction locking.

15. The device as in claim 1 wherein said locking means is a spring actuated T-shaped clamp element.

16. The device of claim 1 wherein said locking means is a band encircling said slip piece and said tubes.

17. The device of claim 1 wherein the exterior surfaces of said tubes and the interior surfaces of said chambers have D-shaped profiles.

18. A swimmer mouthpiece comprising a hollow tube having a first hollow segment and a second hollow segment angularly disposed with respect to each other forming an elbow;

a hollow third segment in communication with said hollow tube; and means affixing said third member to said tube at said elbow at an acute angle to said plane.

19. The mouthpiece of claim 18 wherein the outer surface of said hollow third segment is serrated.

20. A swimming device comprising a mouthpiece;

a pair of breathing tubes each fluid-connected at one end to said mouthpiece to allow a swimmer to inhale and exhale air through the breathing tubes during use;

a slip piece slidably coupled to said pair of tubes to allow for size adjustment of the device about the swimmer's head, said slip piece comprising a body having a clamping pocket and an open-ended chamber extending from said clamping pocket in which said pair of tubes is positioned; and said locking assembly comprises a clamp element positioned for reciprocal movements within said clamping pocket between a clamping position wherein said clamp element positionally restrains said pair of tubes within said clamping pocket and a release position wherein said clamp element is separated from said tubes to thereby allow said body to be slidably moved therealong to allow for adjustment of the swimming device; and a spring element coupled to said clamp element for exerting a bias force on said clamp element in a direction toward said clamping position sufficient to positionally restrain said tubes within said clamping pocket, but insufficient to collapse substantially said tubes and thereby allow air to be passed therethrough when said clamp element is in said clamped position.

21. A swimming device comprising a mouthpiece;

a pair of breathing tubes, each fluid-connected at one end to said mouthpiece to allow a swimmer to inhale and exhale air through the breathing tubes during use;

a slip piece slidably coupled to said pair of tubes to allow for size adjustment of the device about the swimmer's head; and said slip piece having (i) a circumferential channel formed thereabout and (ii) an open-ended chamber extending from said channel in which said pair of tubes is positioned; and a band element positioned for movement within said channel between a locked position wherein said band positionally restrains said pair of tubes, and a release position wherein said band element is separated from said tubes to thereby allow said slip piece to be slidably moved therealong to allow for adjustment of the swimming device.

* * * * *